US011528553B2

(12) United States Patent
Shen et al.

(10) Patent No.: US 11,528,553 B2
(45) **Date of Patent: *Dec. 13, 2022**

(54) SPEAKER WITH DUAL RESONANCE CHAMBERS

(71) Applicant: Hewlett-Packard Development Company, L.P., Spring, TX (US)

(72) Inventors: Kai Lin Shen, Taipei (TW); Sheng Hung Wang, New Taipei (TW); Penhao Ma, Taoyuan (CN); Wei-Min Liang, Hsinchu (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 4 days.

This patent is subject to a terminal disclaimer.

(21) Appl. No.: 17/148,308

(22) Filed: Jan. 13, 2021

(65) Prior Publication Data

US 2022/0014842 A1 Jan. 13, 2022

Related U.S. Application Data

(63) Continuation-in-part of application No. 16/925,177, filed on Jul. 9, 2020.

(51) Int. Cl.

| | |
|---|---|
| ***H04R 1/30*** | (2006.01) |
| ***H04R 1/28*** | (2006.01) |
| ***H04R 9/06*** | (2006.01) |

(52) U.S. Cl.

CPC ..... *H04R 1/2849* (2013.01); *H04R 1/2811* (2013.01); *H04R 9/06* (2013.01); *H04R 2201/10* (2013.01)

(58) Field of Classification Search

CPC ..... H04R 1/2807; H04R 1/30; H04R 1/2861; H04R 1/2865; H04R 1/10; H04R 2205/022

See application file for complete search history.

(56) References Cited

U.S. PATENT DOCUMENTS

| | | | | |
|---|---|---|---|---|
| 4,058,688 | A * | 11/1977 | Nishimura | H04R 1/1008 381/372 |
| 4,239,945 | A | 12/1980 | Atoji | |
| 6,035,051 | A * | 3/2000 | Sato | H04R 5/02 381/89 |
| 6,758,303 | B2 * | 7/2004 | Zurek | H04M 1/035 381/357 |
| 9,942,648 | B2 | 4/2018 | Azmi et al. | |
| 10,171,905 | B2 | 1/2019 | Wen et al. | |
| 10,257,607 | B2 | 4/2019 | Wen et al. | |
| 10,771,886 | B2 | 9/2020 | Han | |

(Continued)

*Primary Examiner* — Suhan Ni

(57) ABSTRACT

The inventive subject matter is directed to headset audio systems having resonance chambers designed to improve a system's frequency response in certain ranges. Systems of the inventive subject matter include a casing that both holds a speaker driver and creates two resonance chambers. Each resonance chamber vents to ambient air outside the casing, where the length and cross-sectional areas of each vent can impact the system's frequency response. Each resonance chamber is tuned to a resonant frequency to improve the system's frequency response across a range of frequencies on either side of each chamber's resonant frequency.

16 Claims, 10 Drawing Sheets

(56) References Cited

U.S. PATENT DOCUMENTS

2008/0063223 A1* 3/2008 van Halteren ..... H04R 1/24
381/182
2009/0087008 A1* 4/2009 Danley ..... H04R 1/2865
381/340

* cited by examiner

SPEAKER WITH DUAL RESONANCE CHAMBERS

This application is a continuation in part of and claims priority to U.S. patent application Ser. No. 16/925,177, filed Jul. 9, 2020. All extrinsic materials identified in this application are incorporated by reference in their entirety.

FIELD OF THE INVENTION

The field of the invention is headset audio systems.

BACKGROUND

The background description includes information that may be useful in understanding the present invention. It is not an admission that any of the information provided in this application is prior art or relevant to the presently claimed invention, or that any publication specifically or implicitly referenced is prior art.

Headset audio systems are subject to steady improvement, and with their increasing popularity, especially among gamers, a need exists to create headset audio systems that can reproduce sounds with increasing accuracy and fidelity. One way to do this is to create headset audio systems that feature chambers behind a speaker's diaphragm.

U.S. Pat. Nos. 10,257,607 and 10,171,905 represent efforts made to improve the state of the art in this field. The devices captured in the '607 and the '905 Patents feature headset audio systems having chambers, but those chambers are not optimally configured to cooperate with one another in a way that allows for improved sound performance in different frequency ranges. U.S. Pat. No. 9,942,648 is another example of efforts made in this space. The '648 Patent describes an earbud audio system instead of a headset audio system, where the earbud audio system includes multiple chambers behind a driver.

But none of these references contemplate advantages conferred by more creative headset audio system configurations featuring multiple chambers that are tuned to have resonant frequencies within certain frequency bands to improve frequency response of headset audio systems within those frequency bands. Thus, a need still exists in the art for improved headset audio systems.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

SUMMARY OF THE INVENTION

The present invention is directed to headset audio systems and methods. In one aspect of the inventive subject matter, a headset audio system is contemplated to include: a casing comprising an upper portion, a lower portion, a first resonance chamber, a second resonance chamber, a first vent, and a second vent; a speaker driver disposed between the upper portion and the lower portion, where the first resonance chamber is separated from the second resonance chamber by at least one wall and where the first vent couples with the first resonance chamber and creates a first pathway from the first resonance chamber to the casing's exterior. The second vent then couples with the second resonance chamber and creates a second pathway from the second resonance chamber to the casing's exterior; the speaker driver has a diaphragm, where a front side of the diaphragm projects sound away from the casing and a back side of the diaphragm projects sound into both the first resonance chamber and the second resonance chamber; the first resonance chamber has a first resonant frequency; and the second resonance chamber has a second resonant frequency that is different from the first resonant frequency.

In some embodiments, the first resonant frequency is between 60 Hz and 250 Hz and the second resonant frequency is between 500 Hz and 2 kHz. The first and second resonance frequencies can exist between 20 Hz to 60 Hz, 60 Hz to 250 Hz, 250 Hz to 500 Hz, 500 Hz to 2 kHz, 2 kHz to 4 kHz, 4 kHz to 6 kHz, or 6 kHz to 20 kHz without deviating from the inventive subject matter. In some embodiments, the first vent has a length between approximately 15-40 mm, and the second vent has a length between approximately 2-15 mm. The first vent can have a cross-sectional area between approximately 20-60 $mm^2$, and the second vent can have a cross-sectional area between approximately 20-60 $mm^2$.

In another aspect of the inventive subject matter, another headset audio system is contemplated to include: a casing comprising a first resonance chamber having a first resonant frequency, a second resonance chamber having a second resonant frequency that is different from the first resonant frequency, a first vent, and a second vent, where the first vent creates a pathway between the first resonance chamber and the casing's exterior and where the second vent creates a pathway between the second resonance chamber and the casing's exterior; and a speaker driver disposed within the casing, the speaker driver comprising a diaphragm, where a front side of the diaphragm projects sound away from the casing and a back side of the diaphragm projects sound into both the first resonance chamber and the second resonance chamber.

In some embodiments, the first resonant frequency is between 60 Hz and 250 Hz and the second resonant frequency is between 500 Hz and 2 kHz. The first and second resonance frequencies can exist between 20 Hz to 60 Hz, 60 Hz to 250 Hz, 250 Hz to 500 Hz, 500 Hz to 2 kHz, 2 kHz to 4 kHz, 4 kHz to 6 kHz, or 6 kHz to 20 kHz without deviating from the inventive subject matter. In some embodiments, the first vent has a length between approximately 15-40 mm, and the second vent has a length between approximately 2-15 mm. The first vent can have a cross-sectional area between approximately 20-60 $mm^2$, and the second vent can have a cross-sectional area between approximately 20-60 $mm^2$.

One should appreciate that the disclosed subject matter provides many advantageous technical effects including the ability to tune headset audio systems for improved sound reproduction in targeted frequency ranges. Various objects, features, aspects, and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Figure 1:
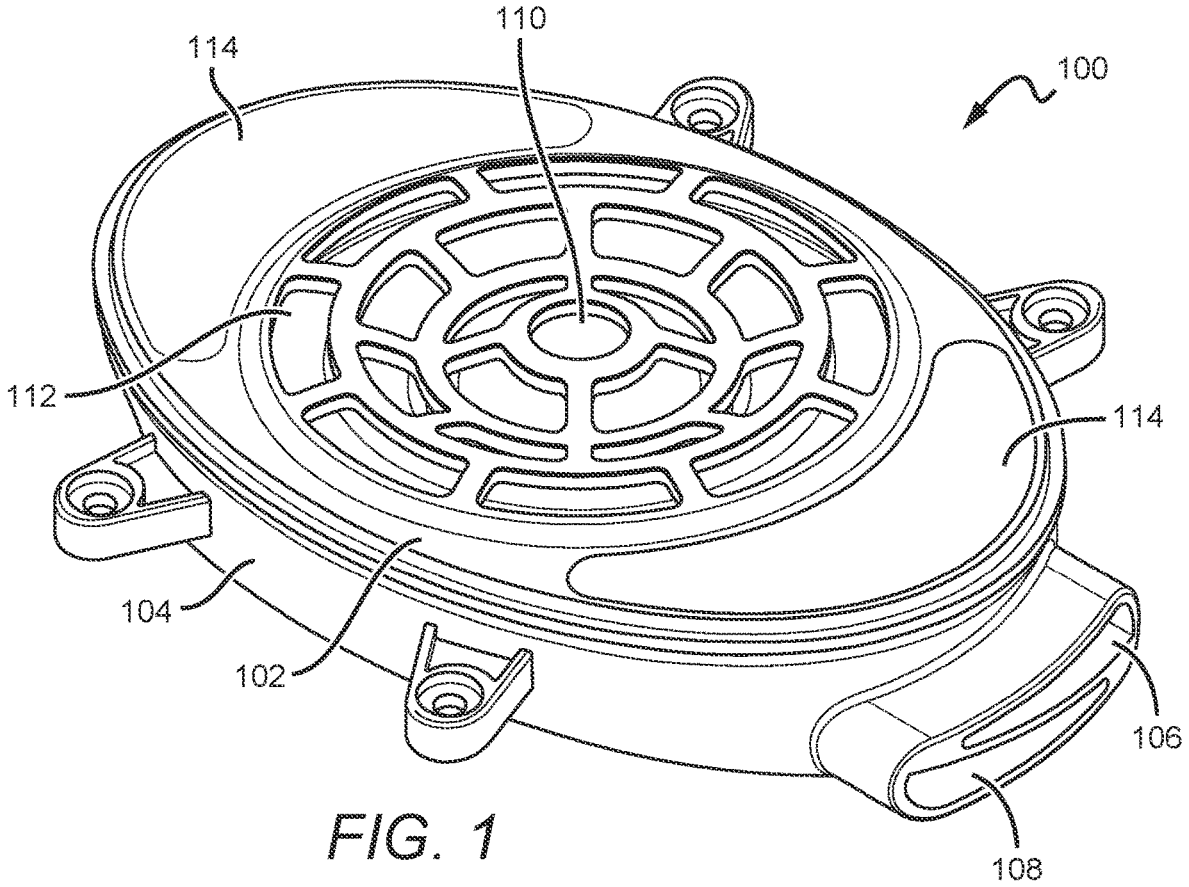
FIG. 1 is a top, left view of a headset audio system of the inventive subject matter.

FIG. 1 shows a headset audio system 100 of the inventive subject matter. Headset audio systems of the inventive subject matter can be incorporated to any type of headset, including over-ear and on-ear headsets used for, e.g., listening to music or gaming. Upper casing 102 is shown coupled to lower casing 104. Upper casing 102 features through holes for sound waves generated by an audio driver disposed within the upper and lower casings to pass through. The audio driver's membrane is visible through those through holes, where the audio driver's diaphragm is made up of at least a center dome 110 and an outer membrane 112.

Upper casing 102 also features acoustic damper mesh 114. Acoustic damper mesh 114 is designed to absorb sound, and, as shown in, e.g., FIGS. 1 and 4, this mesh is placed over portions of upper casing 102 to allow some sound to escape from chamber 118 that exists on the one side of the acoustic damper mesh 114. Acoustic damper mesh 114 can be selected based on its material properties and how it interacts with sound waves. For example, acoustic damper 114 material can be selected based on its favorable interactions with low to mid-low frequencies (e.g., around 20 Hz to around 500 Hz). Acoustic damper mesh 114 can be made from one or any combination of, e.g., a non-woven fabric, stainless steel, polymer mesh, etc.

Figure 2:
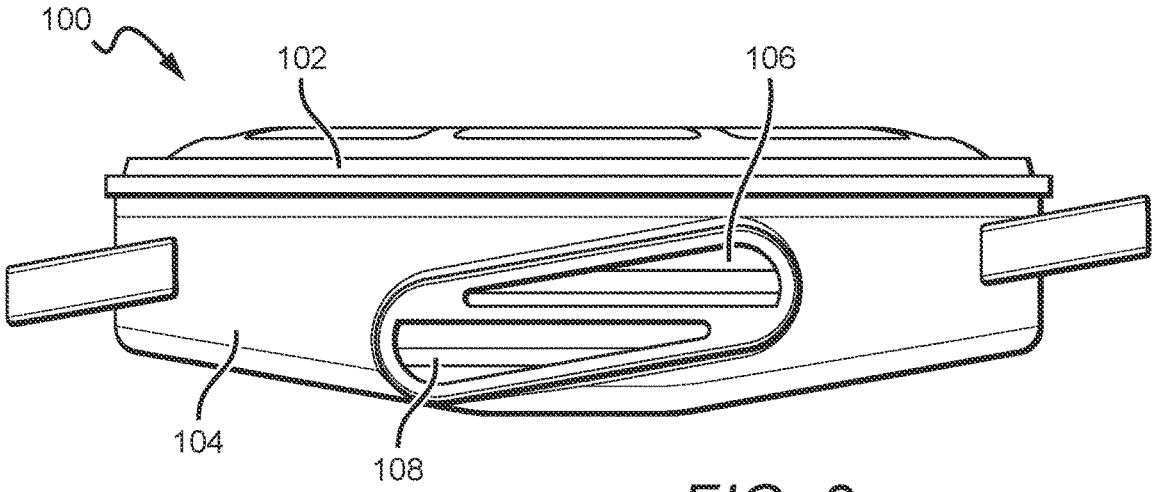
FIG. 2 is a front view of the same.

Lower casing 104 couples with upper casing 102. It can couple with upper casing 102 by pressure fit, by snapping together, by adhesive, by fastener, etc. FIG. 2 shows upper casing 102 coupled with lower casing 104, where lower casing 104 features two vents 106 and 108. Each vent leads to a corresponding resonance chamber inside the headset audio system 100. Resonance chambers inside the headset audio system 100 allow for sound waves coming off the back side of the audio driver's membrane to exit into ambient air. Vents 106 and 108 are shown as having approximate triangular cross-sectional shapes with some rounding. Other cross-sectional shapes are additionally contemplated, including circular (as shown in the embodiment in FIGS. 12-15), oval, polygonal, etc.

Figure 6:
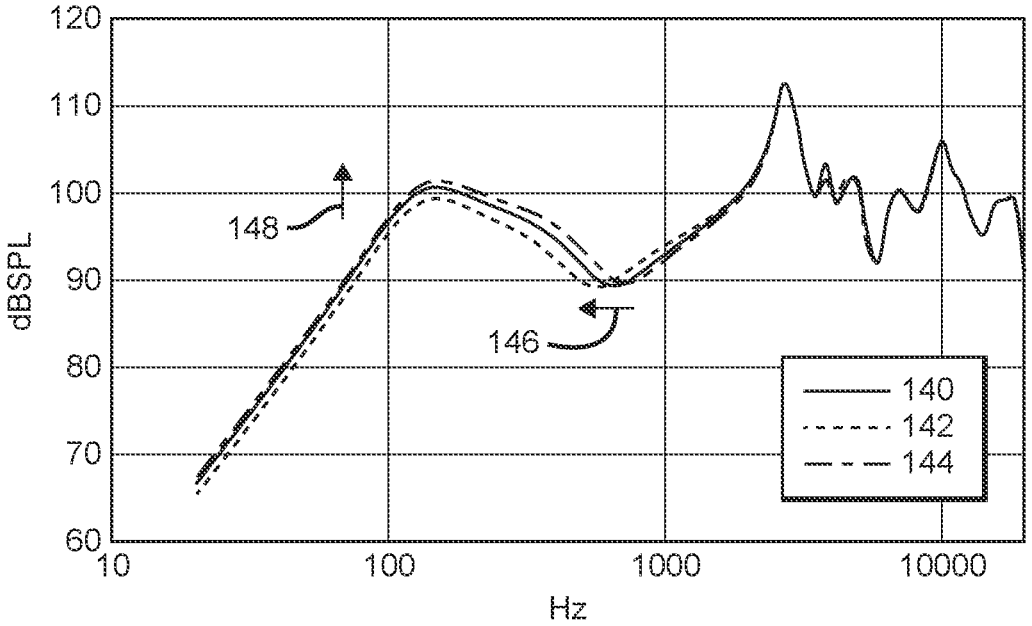
FIG. 6 shows how frequency response changes by changing vent cross-sectional area of the lower vent.

Physical attributes of vents 106 and 108 can both impact performance of the headset audio system 100. For example, FIGS. 6-9 show how frequency response of a headset of the inventive subject matter changes upon adjusting different aspects of vents 106 and 108. FIG. 6, for example, is a frequency response graph demonstrating how changing the cross-sectional area of vent 108 affects frequency response of headset audio system 100. Line 140 represents a baseline frequency response while line 142 represents a frequency response when the cross-sectional area of vent 108 is decreased by 50% from a baseline cross-sectional area of approximately 42 $mm^2$, and line 144 represents a frequency response when the cross-sectional area of vent 108 is instead increased by 50% from the baseline cross-sectional area. This graph thus demonstrates how relative changes in vent cross-sectional area affect frequency response. Line 146 shows how midrange resonance shifts down in frequency with smaller cross-sectional areas, and line 148 shows how bass resonance is affected with smaller cross-sectional areas. In some embodiments, cross sectional area of vent 108 can range from approximately 20 $mm^2$ to approximately 60

$mm^2$. Values outside of these ranges can be implemented without deviating from the inventive subject matter.

Figure 7:
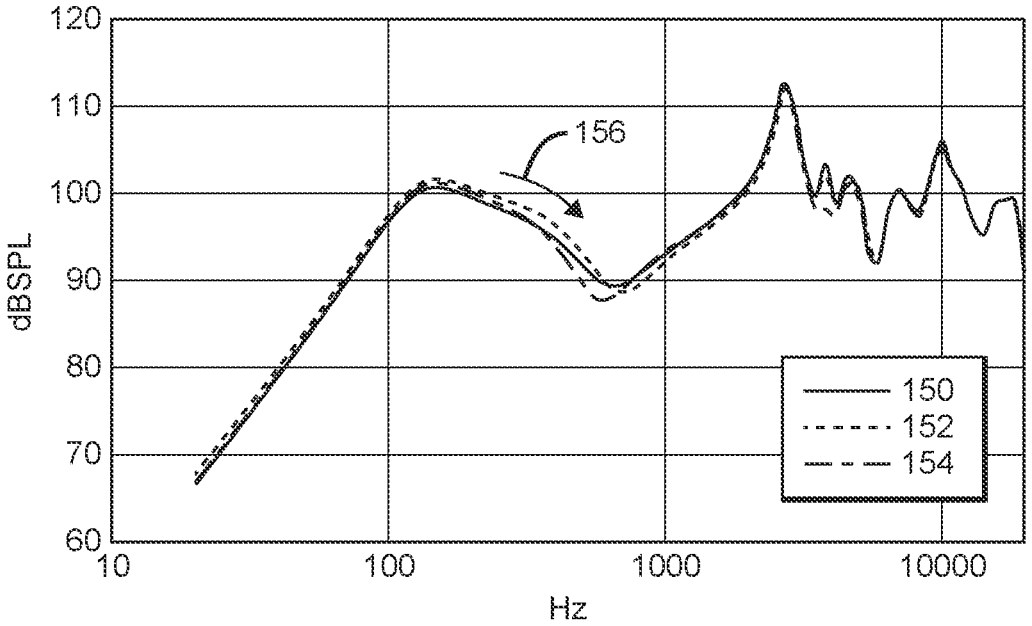
FIG. 7 shows how frequency response changes by changing vent length of the lower vent.

FIG. 7 shows how the frequency response of headset audio system 100 is affected by changing the length of vent 108. Line 150 represents a baseline frequency response while line 152 represents a frequency response when the length of vent 108 is shortened by 8 mm from a baseline length of approximately 30 mm, and line 154 represents a frequency response when the cross-sectional area of vent 108 is instead increased by 8 mm from the baseline cross-sectional area. This graph thus demonstrates how relative changes in vent length affect frequency response. Line 156 shows how midrange frequency roll off changes with changes to the length of vent 108. Resonance shifts down in frequency with smaller cross-sectional areas, and line 148 shows how bass resonance is affected with smaller cross-sectional areas. In some embodiments, vent 108 length can range from approximately 15 mm to approximately 40 mm and more preferably from approximately 26 mm to approximately 33 mm. Values outside of these ranges can be implemented without deviating from the inventive subject matter.

Figure 8:
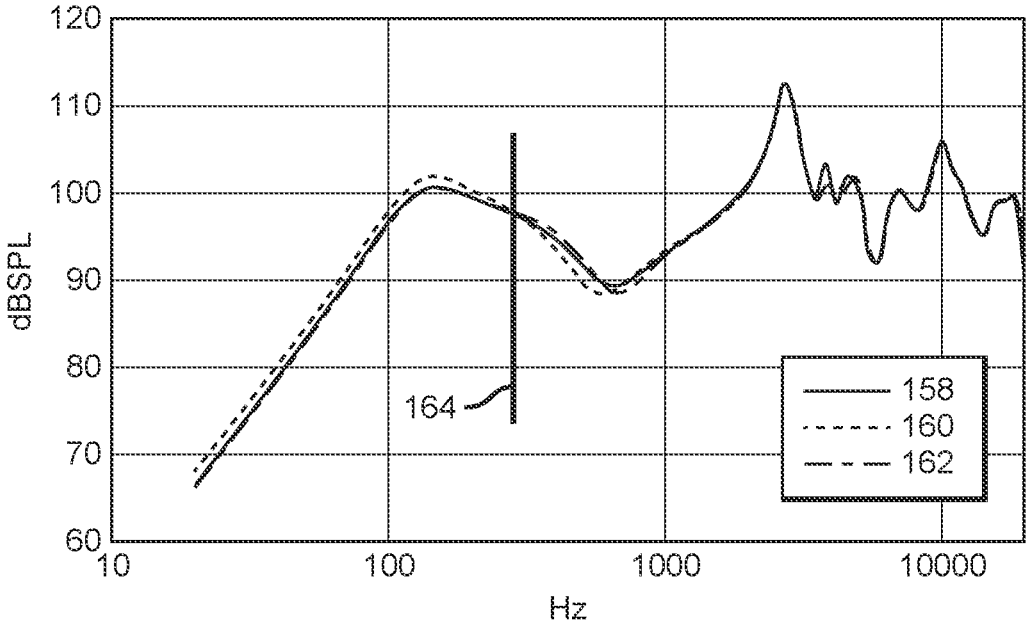
FIG. 8 shows how frequency response changes by changing vent cross-sectional area of the upper vent.

FIG. 8 is a frequency response graph demonstrating how changing the cross-sectional area of vent 106 affects frequency response of headset audio system 100. Line 158 represents a baseline frequency response while line 160 represents a frequency response when the cross-sectional area of vent 106 is decreased by 50% from a baseline cross-sectional area of approximately 42 $mm^2$, and line 162 represents a frequency response when the cross-sectional area of vent 106 is instead increased by 50% from the baseline cross-sectional area. This graph thus demonstrates how relative changes in vent cross-sectional area affect frequency response. Line 164 is placed at a frequency inflection point (e.g., between 300 Hz and 400 Hz) where midrange frequency roll-off changes with changes to vent cross-sectional area. In some embodiments, cross sectional area of vent 106 can range from approximately 20 $mm^2$ to approximately 60 $mm^2$. Values outside of these ranges can be implemented without deviating from the inventive subject matter.

Figure 9:
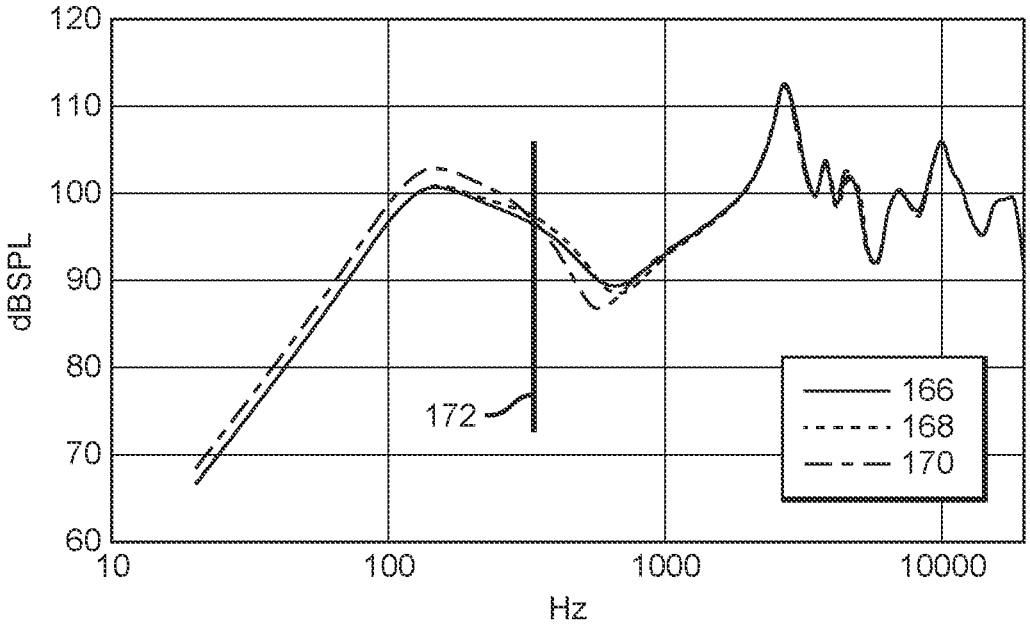
FIG. 9 shows how frequency response changes by changing vent length of the upper vent.

FIG. 9 shows how the frequency response of headset audio system 100 is affected by changing the length of vent 106. Line 166 represents a baseline frequency response while line 168 represents a frequency response when the length of vent 106 is shortened by 4 mm from a baseline length of approximately 8.5 mm, and line 170 represents a frequency response when the length of vent 106 is instead increased by 8 mm from the baseline length. This graph thus demonstrates how relative changes in vent length affect frequency response. Line 172 is placed at a frequency where midrange frequency roll-off changes with changes to vent length. In some embodiments, vent 108 length can range from approximately 2 mm to approximately 15 mm and more preferably from approximately 7.5 mm to approximately 10 mm. Values outside of these ranges can be implemented without deviating from the inventive subject matter.

It is contemplated that each resonance chamber 116 and 118 and associated vent 108 and 106, respectively, can be tuned according to principles that apply to Helmholtz resonators. A Helmholtz resonator has a cavity with an opening at one end (e.g., like a beer bottle that can be used to make a sound when air is blown over its opening). The volume of space within the cavity can determine a tone that is generated when air passes over its opening, and the size and shape of the opening can also impact its acoustic properties. In the context of headset audio system 100, the volume and configuration (e.g., shape, material, etc.) of each resonance chamber 116 and 118 and the configuration (e.g., size, shape, length, etc.) of each corresponding vent 108 and 106 thus affects each resonance chamber's resonant frequency.

Thus, each resonance chamber 116 and 118 and corresponding vent 108 and 106 can be tuned such that a range of frequencies in the vicinity of the resonant frequency of a chamber and vent combination improve a headset audio system's ability to produce high quality sound in that frequency range. For example, if chamber 118 and vent 106 are configured to have a resonant frequency (e.g., according to Helmholtz resonance principles) within a band of frequencies associated with bass tones (e.g., a resonant frequency between 60 Hz and 250 Hz such as around 100 Hz), then headset audio system 100 can produce higher quality sounds in the base range. To complement chamber 118 and vent 106, chamber 116 and vent 108 can thus be configured to have a resonant frequency that is within a range of frequencies associated with midrange sounds (e.g., between around 500 Hz and about 2 kHz such as around 1 kHz), which would result in headset audio system 100 also producing higher quality sounds in the midrange.

The same can be true for any other frequency range. For example, the low midrange is generally associated with sounds occurring between about 250 Hz and about 500 Hz, so reproduction of sounds in this frequency range can be improved by creating a resonance chamber and vent that are configured with a resonant frequency that is within that range of frequencies (e.g., around 300 Hz). In another example, the sub bass range is generally associated with sounds occurring between about 20 Hz and about 60 Hz, so reproduction of sounds in this frequency range can be improved by creating a resonance chamber and vent that are configured with a resonant frequency that is within that range of frequencies (e.g., around 35 Hz). In another example, the upper midrange is generally accepted as being sounds occurring between about 2 kHz and about 4 kHz, so reproduction of sounds in this frequency range can be improved by creating a resonance chamber and vent that are configured with a resonant frequency within that range of frequencies (e.g., around 3 kHz). In another example, presence is generally accepted as being sounds occurring between about 4 kHz and about 6 kHz, so reproduction of sounds in this frequency range can be improved by creating a resonance chamber and vent that are configured with a resonant frequency within that range of frequencies (e.g., around 5 kHz). In another example, brilliance is generally accepted as being sounds occurring between about 6 kHz and about 20 kHz (where 20 kHz is often described as an upper limit of sounds the human ear can detect, depending on the human), so reproduction of sounds in this frequency range can be improved by creating a resonance chamber and vent that are configured with a resonant frequency within that range of frequencies (e.g., around 10 kHz).

Figure 10:
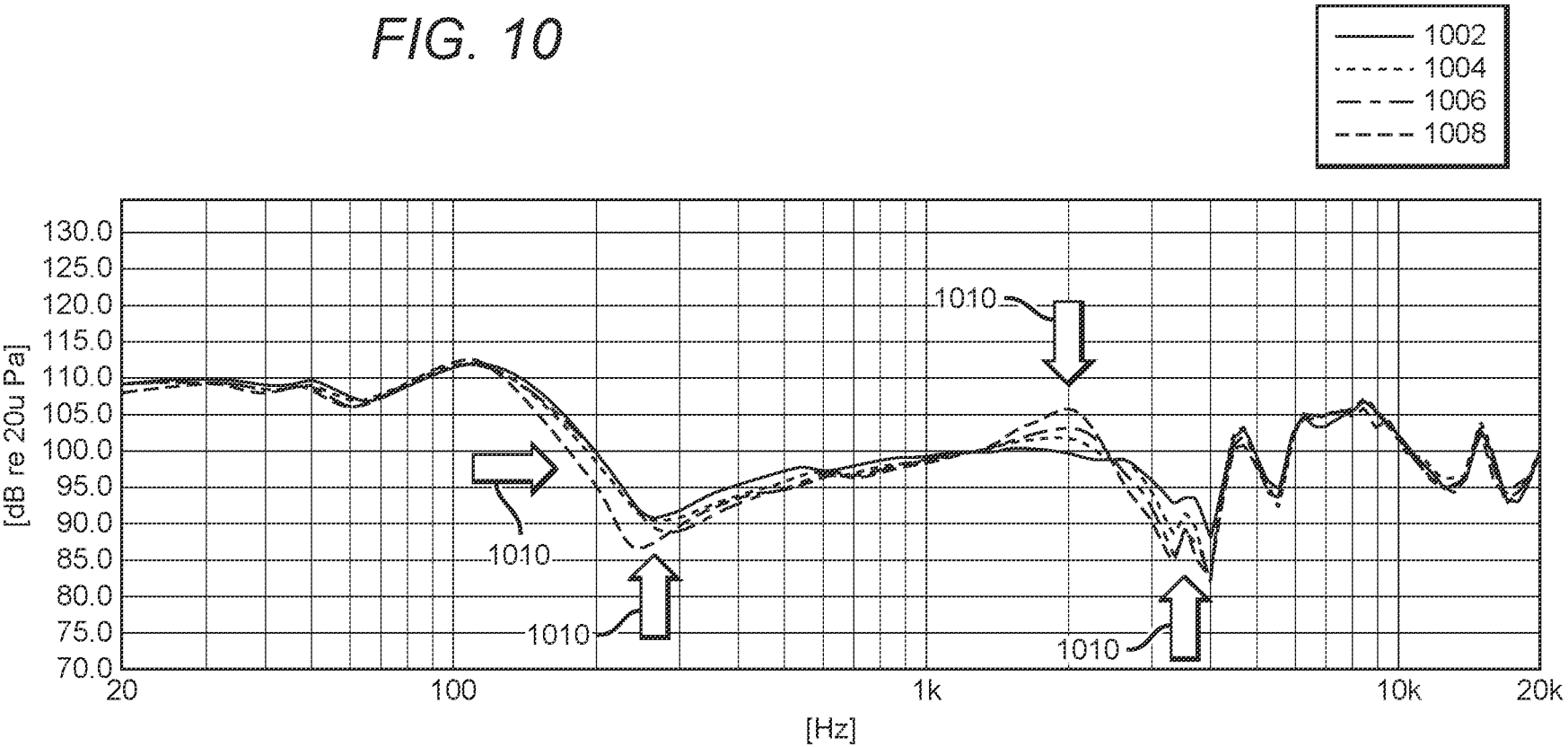
FIG. 10 shows how frequency response changes by changing volume of a resonance chamber.
Figure 11:
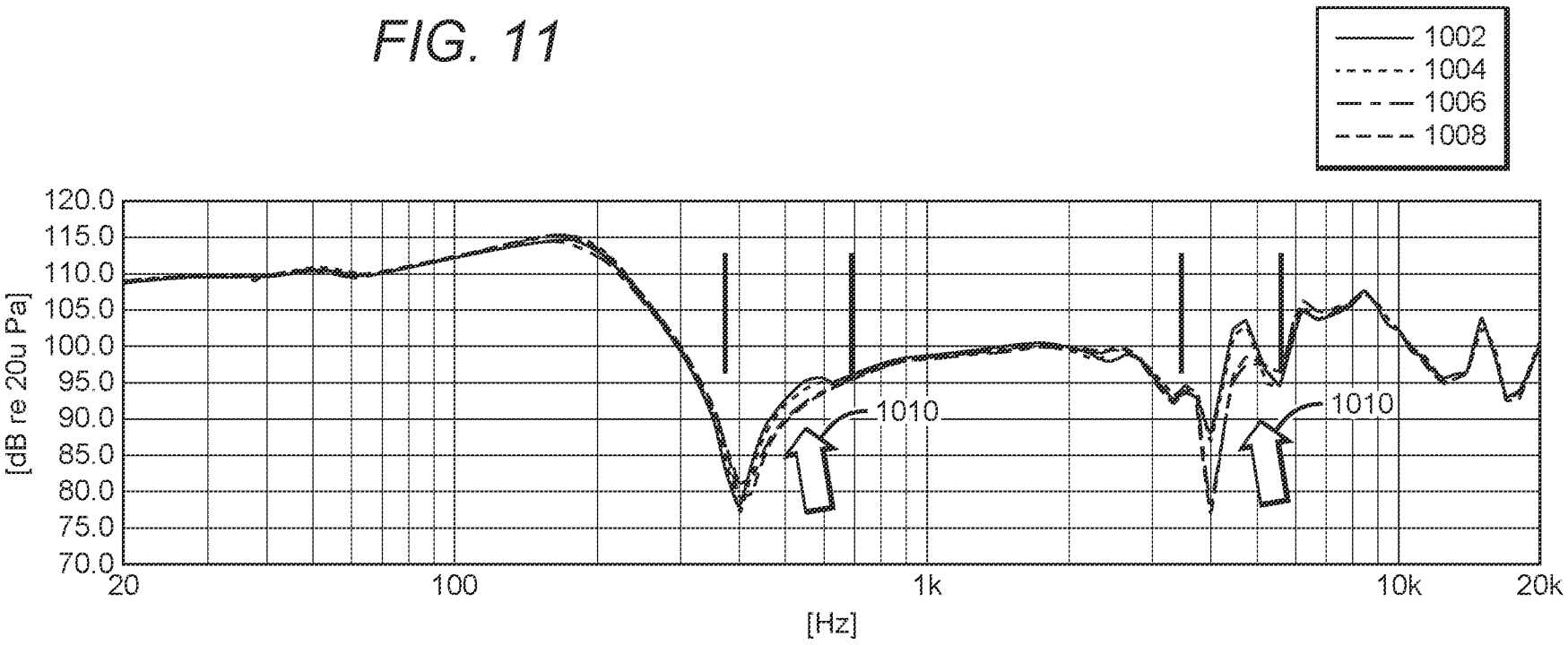
FIG. 11 shows how frequency response changes by changing volume of another resonance chamber.

Thus, as with Helmholtz resonators, the internal volume of a chamber of the inventive subject matter can be adjusted to affect its resonant frequency. For example, FIGS. 10 and 11 show frequency response graphs demonstrating how adjusting internal volumes of chambers 116 and 118 affects a headset audio system's frequency response. FIG. 10 is a frequency response graph 1000 showing changes in frequency response when chamber 118 is changed from approximately 9200 $mm^3$ (line 1002) to approximately 6900 $mm^3$ (line 1004) to approximately 4600 $mm^3$ (line 1006) to approximately 2300 $mm^3$ (line 1008). Frequencies between 100 Hz and 5 kHz are primarily influenced by these changes, as shown by arrows 1010. Thus, it is contemplated that chamber 118 can have a volume at or between any of the volumes cited above, though higher volumes are also contemplated, such as 9200 $mm^3$ up to approximately 15000 $mm^3$.

FIG. 11 is a frequency response graph 1100 showing changes in frequency response when chamber 116 is changed from approximately 2650 $mm^3$ (line 1102) to approximately 2000 $mm^3$ (line 1104) to approximately 1300 $mm^3$ (line 1106) to approximately 660 $mm^3$ (line 1108). Frequencies between 400 Hz and 700 Hz as well as between 3.5 kHz and 5.5 kHz are primarily influenced by these changes in volume, as shown by arrows 1110. The most dramatic changes are seen between 3.5 kHz and 5.5 kHz.

It is contemplated that if resonance chamber 116 and vent 108 are configured to improve sound quality within a certain frequency range, then resonance chamber 118 and vent 106 can be configured to improve sound quality within a different frequency range, where the frequency ranges discussed above can be implemented for each of the vent/chamber pairs.

Thus, resonance chamber 116 can be tuned for sub bass, bass, midrange, upper midrange, presence, or brilliance, and resonance chamber 118 can be used for any one of those same ranges. In some embodiments, resonance chamber 116 is tuned for a different range than resonance chamber 118, but it is contemplated that both resonance chambers can be tuned to improve performance within the same range of frequencies where, e.g., one resonance chamber is tuned such that its resonant frequency is in the lower end of a range than the other resonance chamber.

In some embodiments, lower casing 104 features coupling protrusions having, e.g., screw holes that can be used to hold headset audio systems of the inventive subject matter inside a headset's earcup.

Figure 3:
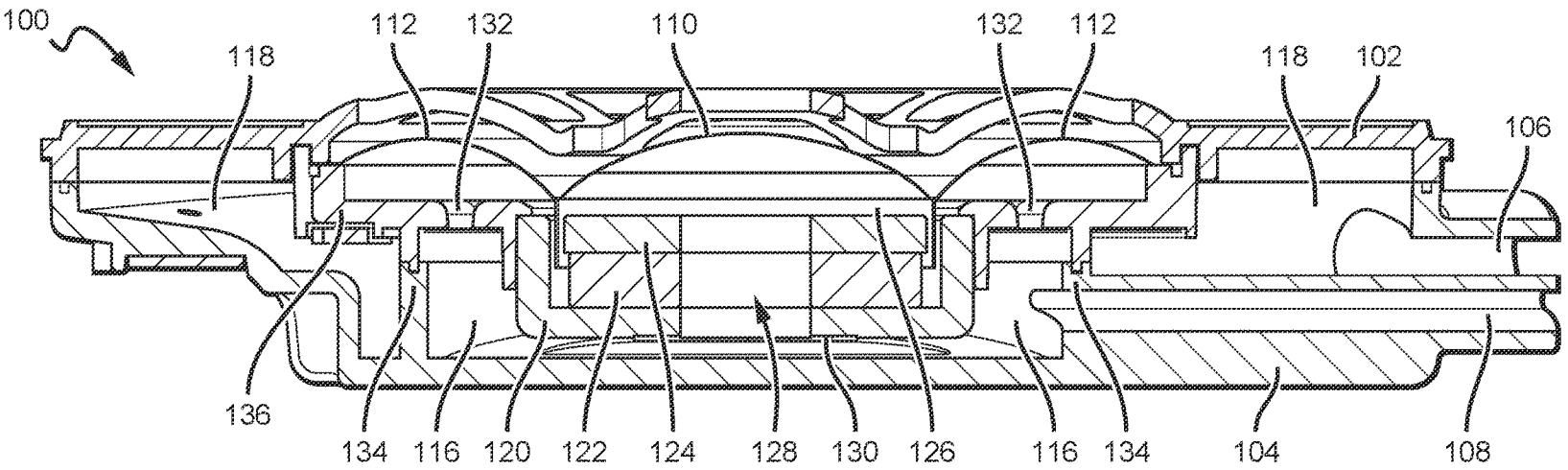
FIG. 3 is a cutaway view of the same.

FIG. 3 shows a cutaway view of headset audio system 100. In this view, resonance chambers 116 and 118 are visible. Resonance chamber 118 (which is disposed around resonance chamber 116 as well as the sound driver, diaphragm, and other components as shown in the figures) vents via vent 106 to ambient air, while resonance chamber 116 vents via vent 108 to ambient air. FIG. 3 also makes interior casing 136 visible. Resonance chambers 116 and 118 are thus configured to couple with the back side of a speaker driver disposed within the headset audio system 100. The speaker driver includes yoke 120, magnet 122, washer 124, and voice coil 126. Yoke 120 can affect and influence magnetic interaction between the voice coil 126 and a magnetic field from magnet 122. Magnet 122 is typically a permanent magnet (e.g., a magnet made from a ceramic, a ferrite, an alnico, or a rare earth magnet such as neodymium or samarium cobalt) generates a magnetic field. Washer 124 conducts magnetic energy in coordination with yoke 120. Finally, voice coil 126 is mounted directly to the diaphragm (which comprises at least dome 110 and outer membrane 112) and, when electricity passes through the voice coil, it temporarily magnetizes voice coil 126 causing it to move relative to magnet 122 causing the diaphragm to create sound.

These components are generally annular in shape, creating a cavity 128 passing therethrough. One side of cavity 128 has a covering 130, which can be made from, e.g., an air permeable membrane that, in effect, makes it so cavity 128 functions as part of resonance chamber 116. In some embodiments, covering 130 is not air permeable.

As mentioned above, as the voice coil 126 moves, it causes dome 110 and outer membrane 112 to create compression waves (also described as sound waves). Sound intended for a listener is projected away from the diaphragm (e.g., upwards as drawn in FIG. 3). But a consequence of sound generation is that sound is generated by both sides of the speaker driver's diaphragm (which includes, e.g., dome 110 and outer membrane 112), causing compression waves to also travel into the interior of a headset audio system. Sound waves that come off the back of the diaphragm, i.e. travel down from dome 110 and outer membrane 112 to reflect off surfaces in, e.g., resonance chamber 116, can impact performance of a speaker driver. Sound waves coming off the back of a speaker driver can negatively impact speaker performance, and to improve speaker driver performance, headset audio system 100 includes two resonance chamber 116 and 118 with vents 106 and 108. The shape and configuration of resonance chamber 116 can improve speaker performance according to the principles discussed above regarding resonant frequencies.

Resonance chamber 116 is separated by from resonance chamber 118 in part by wall 134. Wall 134, which is annular, is formed through the mating of protrusions from both the lower casing 104 and the interior casing 136. These protrusions are depicted as having complementary notches, where the notches help to align both portions (e.g., the interior casing portion and the lower casing portion) of wall 134 to create and keep separate resonance chambers 116 and 118. As shown in FIG. 3, resonance chamber 116 is formed by portions of lower casing 104, interior casing 136, wall 134, as well as, in some embodiments, portions of the speaker driver (e.g., yoke 120), and, in some embodiments, resonance chamber 116 includes cavity 128 as well as space behind dome 110. Resonance chamber 118 is formed by portions of upper casing 102, lower casing 104, wall 134, and interior casing 136. In some embodiments, all, or a portion, of interior casing 136 can instead be incorporated into (e.g., formed as a part of) upper casing 102, lower casing 104, or a combination of both.

Figure 4:
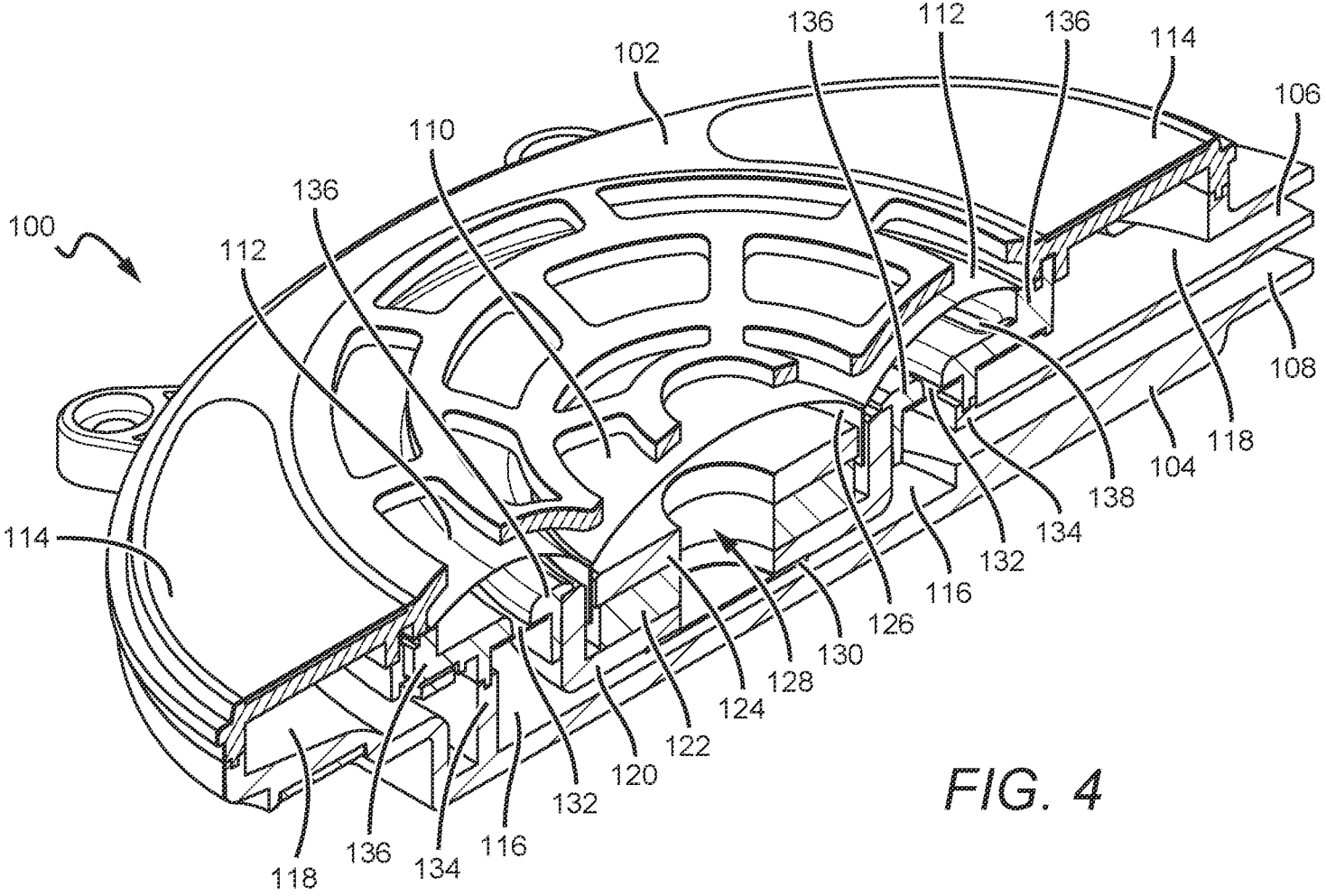
FIG. 4 is a rear, left cutaway view of the same.

Thus, as described above, as a speaker driver generates sound, compression waves travel into both resonance chambers 116 and 118. Resonance chamber 116 primarily receives compression waves from both dome 110 (e.g., via cavity 128) and outer membrane 112 (e.g., via channels 132), and resonance chamber 118 primarily receives compression waves from outer membrane 112. In some embodiments, depending on desired resonant frequencies, resonance chamber 118 can be sized and dimensioned to be larger or smaller, e.g., volumetrically, than resonance chamber 116. Thus, the present invention permits robust amplification of human-audible frequencies (e.g., up to two frequency ranges as up to two chambers are contemplated) within a headset by providing two separate amplification chambers that are separately vented. Channels 132 and 138 are disposed around the speaker driver as cutouts (e.g., formed during molding of the interior casing, cut out of interior casing after forming the interior casing, etc.) in an interior casing 136, as shown in FIG. 4, and those channels allow sound waves to enter resonance chambers 116 and 118. An air permeable material is shown covering channels 132 and 138 (seen best in FIGS. 4 and 5) to, e.g., prevent dust from traveling through vents 106 and 108 and depositing in the volumes of space immediately behind the outer membrane 112 and dome 110.

Figure 5:
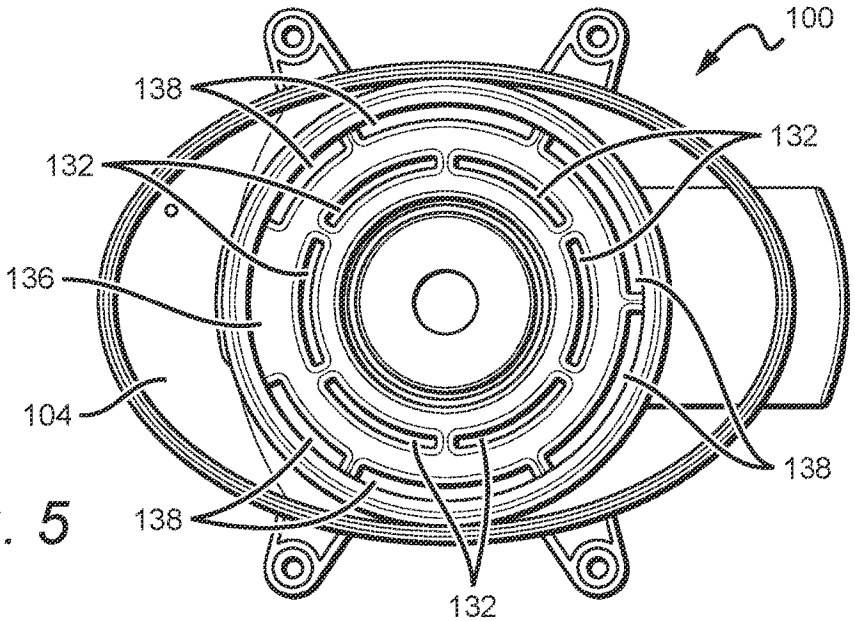
FIG. 5 is a top view of the same without the upper casing shown.

FIG. 5 shows a top view of headset audio system 100 with the upper casing and membrane removed to reveal the interior casing 136. This view shows both sets of channels 132 and 138 disposed around the sound driver in intervals. Channels 132 and 138 are separated from one another and formed as sets of channels instead of as continuous cutouts to maintain structural integrity of the interior casing.

Figure 12:
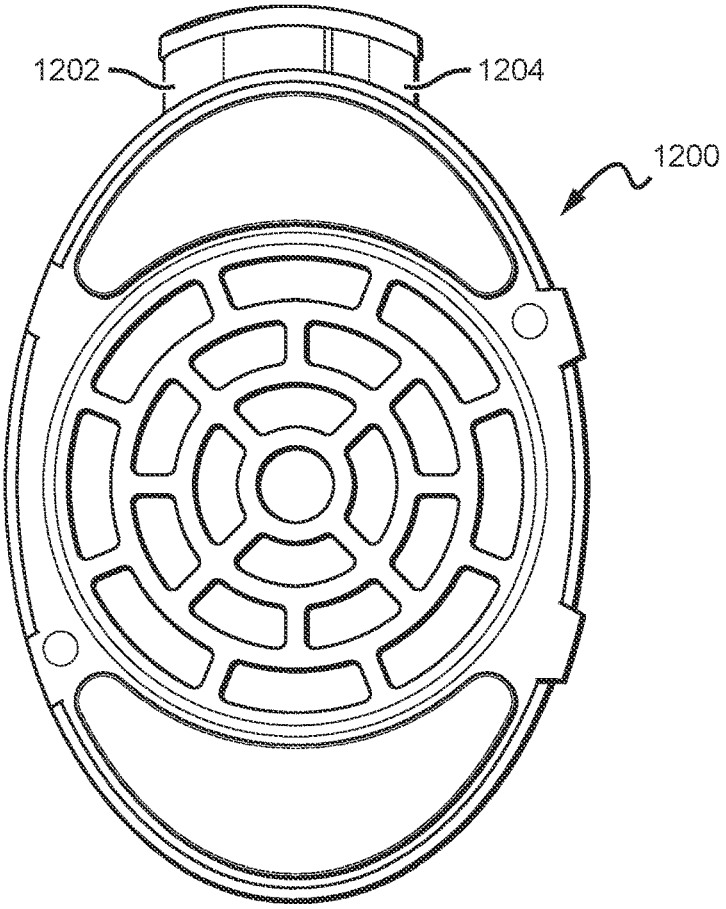
FIG. 12 shows a top view of an embodiment of a headset audio system.

FIGS. 12-15 show another headset audio system 1200 of the inventive subject matter featuring additional venting. FIG. 12 is a top view of headset audio system 1200 housing a speaker driver and featuring two side vents 1202 and 1204. Headset audio system 1200 has a lower casing 1216 and an upper casing 1218 that join together to create an interior space.

Figure 13:
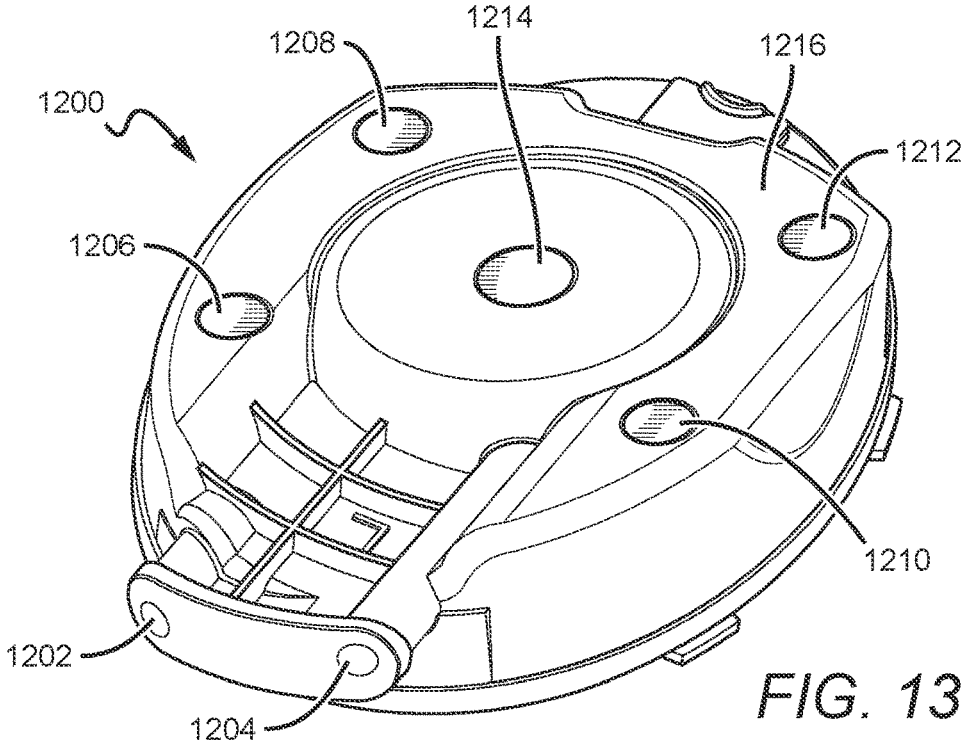
FIG. 13 shows a bottom perspective view of the headset audio system in FIG. 12.
Figure 14:
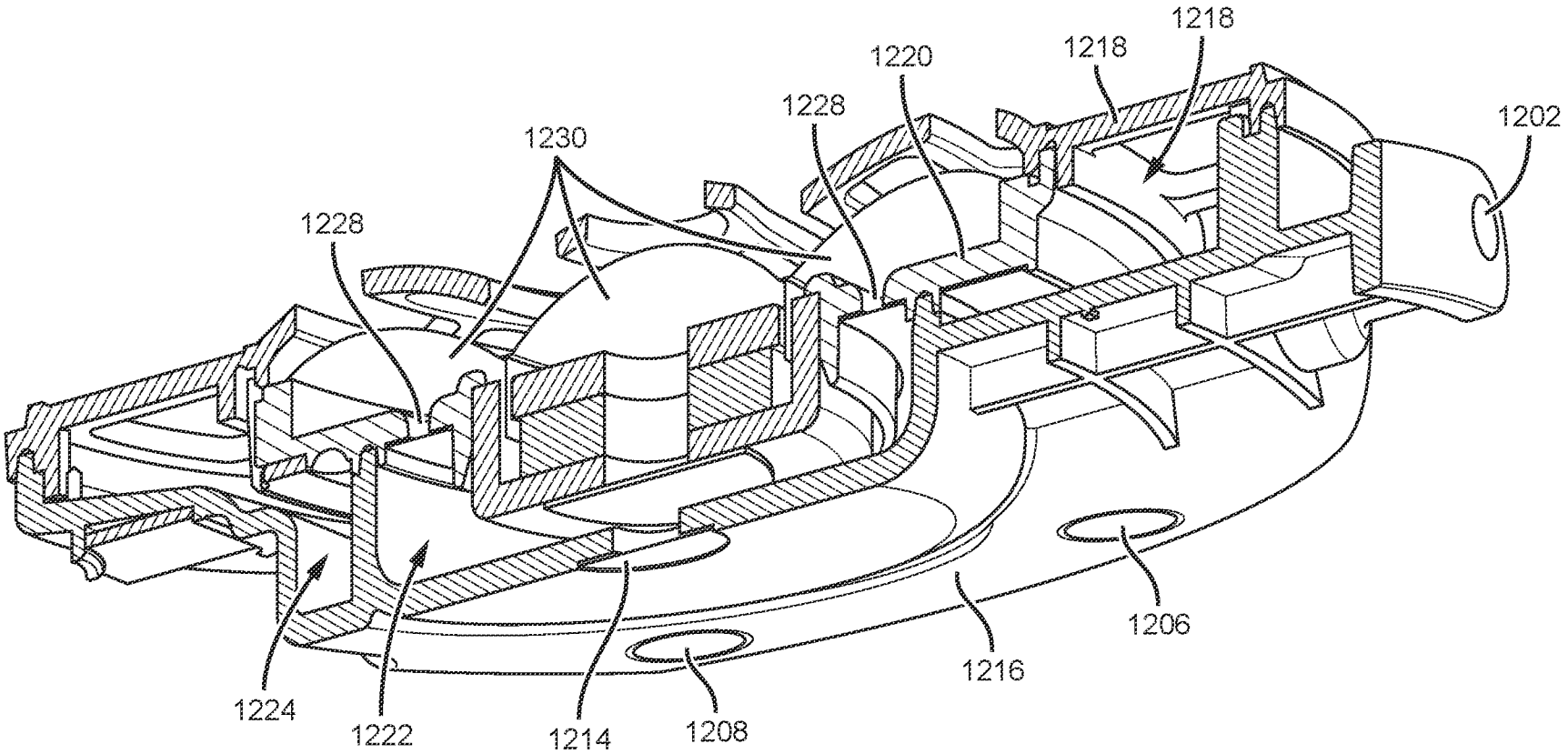
FIG. 14 shows a cutaway view thereof.
Figure 15:
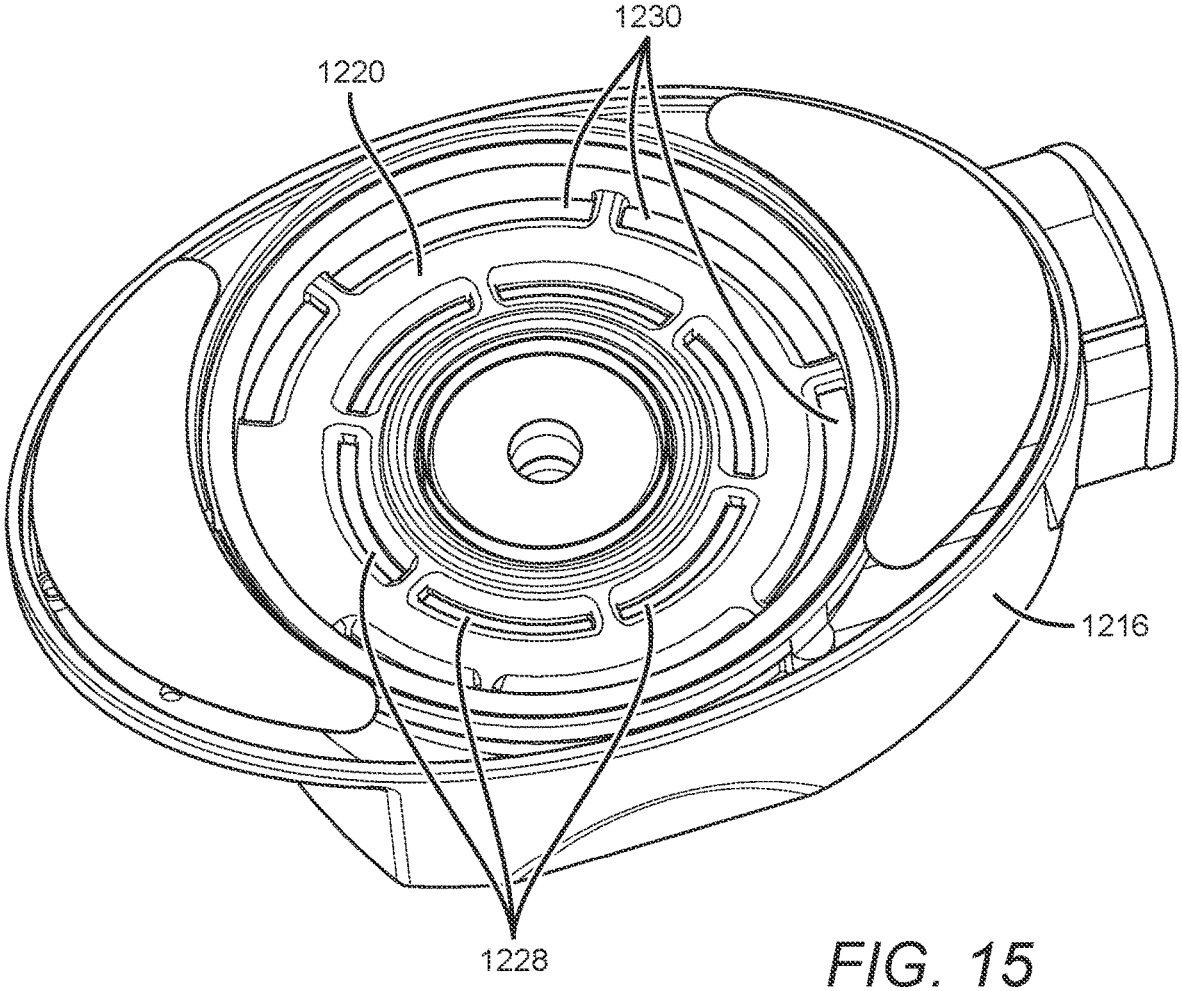
FIG. 15 shows a top perspective view thereof with the top cover and speaker diaphragm hidden.

FIG. 13 shows a bottom perspective view of headset audio system 1200. From this angle, additional vents 1206, 1208, 1210, 1212, and 1214 are visible. Vents 1206, 1208, 1210, 1212, and 1214 are disposed on lower casing 1216. Upper casing 1218 is largely the same as the upper casings described above in other embodiments, and it is contemplated that features from embodiments described above can be incorporated to the embodiment shown in FIGS. 12-15 without deviating from the inventive subject matter. As with embodiments described above, headset audio system 1200 additionally includes an interior casing 1220, which, in association with lower casing 1216, creates inner acoustic chamber 1222 and outer acoustic chamber 1224.

Speaker diaphragm 1226 is configured to project sound out the front of the headset audio system 1200, but sound waves are also projected into the inner and outer acoustic chambers 1222 and 1224. As made visible in FIG. 15, interior casing 1220 features vents 1228 and 1230. Inner vents 1228 allow sound waves to enter inner acoustic chamber 1222, and outer vents 1230 allow sound waves to enter outer acoustic chamber 1224. Inner vents 1228 and outer vents 1230 each include vent covers (e.g., an air permeable material that is visible in the Figures as they cover the entirety of the vent openings) that allow compression waves to pass but prevent dust and other particulate matter from moving between sensitive areas of the headset audio system 1200.

Sound waves that enter inner acoustic chamber 1222 can thus exit via vent 1204 while sound waves that enter outer acoustic chamber 1224 can thus exit via vent 1202. In addition to vents 1204 and 1202, vents 1206, 1208, 1210, and 1212 are also configured to allow compression waves to vent outward from both inner and outer acoustic chambers 1222 and 1224. Each of vents 1206, 1208, 1210, and 1212 features a vent covering made from an air permeable material. Air permeable materials allow for air and sound waves to vent outward while minimizing intrusion of dust and other particulate matter. Vents 1206, 1208, 1210, and 1212 are positioned on lower casing 1216 to allow venting from outer acoustic chamber 1224, while vent 1214 is positioned on lower casing 1216 to allow venting from inner acoustic chamber 1222. Vents 1206, 1208, 1210, 1212, and 1214 can have cross sectional areas of between 3 $mm^2$ and 10 $mm^2$, though some embodiments can have vents with cross sectional areas up to 15-20 $mm^2$. Vents 1202 and 1204 are contemplated as being configurable according to disclosure above regarding vents 106 and 108, including materials, shapes, and specifications such as length and cross-sectional area.

Figure 16:
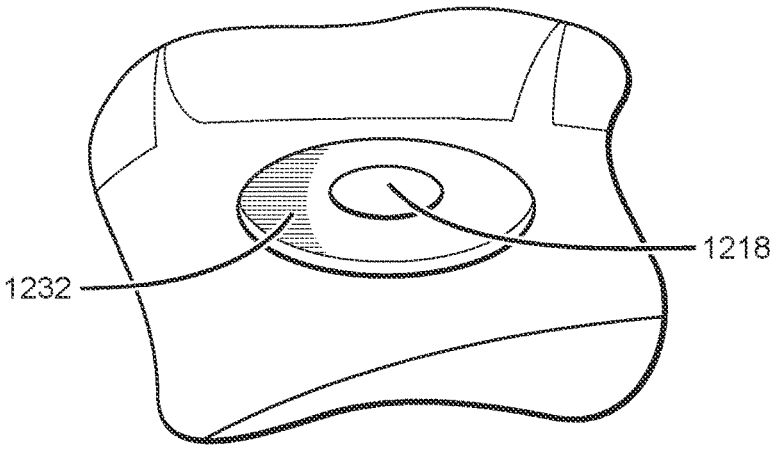
FIG. 16 shows a closeup view of a surface vent.

FIG. 16 shows vent 1212 without its air permeable cover. Each vent location can include a countersunk or counterbored area 1232. This allows for an air permeable cover to the positioned within the counterbored portion to minimize risk of the air permeable being peeled back or otherwise accidentally removed either partially or fully. Each air permeable cover described in this application can be affixed to a surface by, e.g., an adhesive.

A primary difference between headset audio system 1200 shown in FIGS. 12-16 and headset audio system 100 shown in FIGS. 1-5 is that headset audio system 1200 features vents 1206, 1208, 1210, 1212, and 1214. All other features and aspects described and shown in FIGS. 1-5 can be incorporated into the embodiment shown in FIGS. 12-16 without departing from the inventive subject matter.

Thus, specific systems, apparatuses, and methods directed to headset audio systems have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A headset audio system comprising:

a casing comprising an upper portion, a lower portion, a first resonance chamber, a second resonance chamber, a first vent, and a second vent;

a speaker driver disposed between the upper portion and the lower portion;

wherein the first resonance chamber is separated from the second resonance chamber by at least one wall;

wherein the first vent couples with the first resonance chamber and creates a first pathway from the first resonance chamber to the casing's exterior;

wherein the second vent couples with the second resonance chamber and creates a second pathway from the second resonance chamber to the casing's exterior;

the speaker driver comprising a diaphragm, wherein a front side of the diaphragm projects sound away from the casing and a back side of the diaphragm projects sound into both the first resonance chamber and the second resonance chamber;

wherein the first resonance chamber comprises a first resonance chamber vent on a first resonance chamber surface on the lower portion, wherein the first resonance chamber vent comprises a first air permeable cover; and wherein the second resonance chamber comprises a second resonance chamber vent on a second resonance chamber surface on the lower portion, wherein the second resonance chamber vent comprises a second air permeable cover.

2. The system of claim 1, wherein the first resonance chamber has a first resonant frequency between 60 Hz and 250 Hz.

3. The system of claim 1, wherein the second resonance chamber has a second resonant frequency between 500 Hz and 2 kHz.

4. The system of claim 1, wherein the first vent has a length between approximately 15-40 mm.

5. The system of claim 1, wherein the second vent has a length between approximately 2-15 mm.

6. The system of claim 1, wherein the first vent has a cross-sectional area between approximately 20-60 $mm^2$.

7. The system of claim 1, wherein the second vent has a cross-sectional area between approximately 20-60 $mm^2$.

8. A headset audio system comprising:

a casing comprising a first resonance chamber having a first resonant frequency, a second resonance chamber having a second resonant frequency that is different from the first resonant frequency;

wherein the first resonance chamber comprises a first surface vent;

wherein the second resonance chamber comprises a second surface vent;

a first elongated vent and a second elongated vent;

wherein the first elongated vent creates a pathway between the first resonance chamber and the casing's exterior;

wherein the second elongated vent creates a pathway between the second resonance chamber and the casing's exterior;

a speaker driver disposed within the casing, the speaker driver comprising a diaphragm, wherein a front side of the diaphragm projects sound away from the casing and a back side of the diaphragm projects sound into both the first resonance chamber and the second resonance chamber; and wherein the first surface vent and the second surface vent are positioned at the back side of the diaphragm.

9. The system of claim 8, wherein the first resonant frequency is between 60 Hz and 250 Hz.

10. The system of claim 8, wherein the second resonant frequency is between 500 Hz and 2 kHz.

11. The system of claim 8, wherein the first and second resonance frequencies exist between 20 Hz to 60 Hz, 60 Hz to 250 Hz, 250 Hz to 500 Hz, 500 Hz to 2 kHz, 2 kHz to 4 kHz, 4 kHz to 6 kHz, or 6 kHz to 20 kHz.

12. The system of claim 8, wherein the first elongated vent has a length between approximately 15-40 mm.

13. The system of claim 8, wherein the second elongated vent has a length between approximately 2-15 mm.

14. The system of claim 8, wherein the first elongated vent has a cross-sectional area between approximately 20-60 $mm^2$.

15. The system of claim 8, wherein the first surface vent comprises a first air permeable cover and wherein the second surface vent comprises a second air permeable cover.

16. The system of claim 8, wherein the second elongated vent has a cross-sectional area between approximately 20-60 $mm^2$.

* * * * *